US006851480B2

(12) United States Patent
Swoyer et al.

(10) Patent No.: US 6,851,480 B2
(45) Date of Patent: Feb. 8, 2005

(54) GAS OPERATED AUTOMATIC, LIQUID PUMPING SYSTEM FOR WELLS

(75) Inventors: Gerald L. Swoyer, Malvern, PA (US); Charles H. Hunt, Strafford, PA (US); Paul M. Yaniga, Kennett Square, PA (US); Richard J. Bordogna, Malvern, PA (US)

(73) Assignee: Brandywine Energy and Development Company, Inc., Frazier, PA (US)

( * ) Notice: Subject to any disclaimer, the term of this patent is extended or adjusted under 35 U.S.C. 154(b) by 0 days.

(21) Appl. No.: 10/118,463

(22) Filed: Apr. 8, 2002

(65) Prior Publication Data

US 2002/0174983 A1 Nov. 28, 2002

Related U.S. Application Data

(60) Provisional application No. 60/282,398, filed on Apr. 6, 2001.

(51) Int. Cl.[7] ..... E21B 43/18; F04B 47/12

(52) U.S. Cl. ..... 166/372; 166/370; 166/68; 166/106; 166/177.3; 166/325; 417/57; 417/60; 417/555.2

(58) Field of Search ..... 166/369, 370, 166/372, 68, 105, 106, 202, 177.3, 319, 321, 325; 417/56, 57, 58, 60, 555.2

(56) References Cited

U.S. PATENT DOCUMENTS

| | | | | |
|---|---|---|---|---|
| 2,267,902 A | | 12/1941 | Eddins | |
| 2,555,112 A | | 5/1951 | Brown | |
| 3,095,819 A | * | 7/1963 | Brown et al. | 417/57 |
| 3,941,511 A | * | 3/1976 | Morgan | 417/57 |
| 4,070,134 A | | 1/1978 | Gramling | |
| 4,712,981 A | | 12/1987 | Gramling | |
| 4,889,473 A | * | 12/1989 | Krueger | 417/56 |
| 4,923,372 A | * | 5/1990 | Ferguson et al. | 417/53 |
| 4,986,727 A | | 1/1991 | Blanton | |
| 5,253,713 A | * | 10/1993 | Gregg et al. | 166/372 |
| 5,462,115 A | * | 10/1995 | Belden et al. | 166/177.3 |
| 6,554,580 B1 | * | 4/2003 | Mayfield et al. | 417/56 |

FOREIGN PATENT DOCUMENTS

| | | |
|---|---|---|
| CA | 523801 | 4/1956 |
| CA | 1289062 | 9/1991 |

OTHER PUBLICATIONS

Product Specification for ConCoyle Production Device entitled "An Underground Revolution", published on or before Apr. 8, 2002.

Product Specification for JetStar Automatic Casing Plunger, published on or before Apr. 8, 2002.

* cited by examiner

*Primary Examiner*—David Bagnell
*Assistant Examiner*—Jennifer Gay
(74) *Attorney, Agent, or Firm*—Stephen H. Eland; Dann, Dorfman, Herrell and Skillman

(57) ABSTRACT

An improved, unattended, liquid pumping device for oil and gas wells featuring a bellows controlled flow valve that opens and closes at preset pressures. Additionally a well head receiver design that releases shut in production gas below the pumping device and provides a positive pressure differential across the pumping device prior to valve opening.

24 Claims, 5 Drawing Sheets

GAS OPERATED AUTOMATIC, LIQUID PUMPING SYSTEM FOR WELLS

PRIORITY CLAIM

This application claims priority to U.S. Application Ser. No. 60/282,398, filed Apr. 6, 2001, which is hereby incorporated herein by reference.

FIELD OF THE INVENTION

The invention relates to an autonomous pressure actuated liquid pump for use in gas and oil wells. In particular, it relates to liquid lift pumps in which well pressure, acting against an internal bellows or diaphragm, causes an internal flow control valve to open or close thereby releasing or shutting-in well gas flow.

BACKGROUND

The economic viability of marginal petroleum wells depends on the well's product flow and pressure capacity and the rate at which undesirable liquids (i.e., brine) infiltrate the well casing. A number of patents have been issued over the past 50 years addressing oil and gas well swabbing devices that offer the potential for unattended self actuation in an operating well environment. None of these inventions have proven to be operationally acceptable.

One known device is an airlift system, which features a cylindrical pumping device through which the fuel product flows. Flow in the annular passage between the cylindrical device and the well casing or tube walls is eliminated by closing off this area with flexible friction cups (rubber like material) or other mechanical means. A valve controls the flow of liquid and gas through the cylindrical pump. When the valve is closed the well is effectively shut-in. In other words, when the valve is closed the cylindrical pumping device seals the well closed. The resulting pressure build-up below the pump lifts the pump and the liquid above it to the surface. The flow capacity and shut-in pressure capability of the well must be sufficient to accomplish the lift. Upon reaching the well head, the control valve in the pump, is mechanically forced open to release the shut in pressure. The fluid below the pump then flows through the pump and out of the well.

Two basic approaches have been used in prior devices to close the flow control valve after the cylindrical pump has reached the desired location in the well. In some applications the flow control valve is forced closed by the impact of the pump striking a fixed stand located in the well. Situations develop operationally, however, where the fluid above the stand rises to a level that is too high for the subsequent shut-in pressure of the well, and the lift can not be accomplished. When this occurs, the well continues to be shut in until the cylindrical pumping device is mechanically retrieved from the bottom of the well.

In other applications, such as in the device disclosed in U.S. Pat. No. 4,986,727 of Blanton, the valve is closed when the well pressure is sufficient to overcome the resistance of a pressurized bellows in the device. This well pressure (set point pressure) is composed of both the flow pressure (also referred to as back pressure or casing pressure) and the hydrostatic pressure resulting from the column of liquid above the control valve.

Because the pumping device does not sense liquid level but is pressure activated, the control valve closes whenever the pressure at the valve reaches the set point pressure. Also, regardless of the pressure level in the well, the pumping device will descend into the well whenever the pressure differential across it (top to bottom) decrease to less than about 10 PSI. When the control valve is mechanically forced open, at the well head, the pressure differential across the swabbing device approaches zero.

Field experience indicates that when the control valve is forced open the unattended pumping device routinely drops down the well while the well was still flowing at very high pressure following shut-in. This has resulted in erratic operation, partial fluid lifts, valve cycling, and dry device lifts that have caused damage to the pumping device as well as to the supporting equipment at the well head. To prevent this, it was found necessary to hold the pumping device at the well head until the casing pressure dissipated to a normal operating level. This has required the design of automated latching devices to restrain the pumping device at the surface, using either maintenance personnel or timing devices to activate a release when the casing pressure is reduced to an acceptable working level. These solutions have added to the cost and complexity of the installations.

SUMMARY OF THE INVENTION

This invention provides a self-actuating solution to overcome the shortcomings of the prior art devices. First, the pump is operable to retrieve a preset amount of liquid instead of trying to lift all of the liquid in the well. Second, by eliminating the flow of the exhausting fuel products through the pumping device when it is at the surface, the present invention reduces or eliminates the need for forcing the control valve open when the pumping device is at the well head. Third, the physical relationship of the control valve seating area to the bellows effective cross sectional area is designed to maintain the control valve in a closed position at the well head, until the well pressure dissipates to an acceptable level for continuing liquid pumping operations. Also, the invention may include a well head receiver that both cushions the pump against shock on its upward travel, and suspends the pump until the pressure is reduced. This invention reduces or eliminates the operational need for electricity, radio communications, timers, or extra maintenance support at remote well sites and provides self activated well pumping that will accommodate variations in service line pressure and well liquidification rates.

DETAILED DESCRIPTION OF THE PREFERRED EMBODIMENTS

The present invention operates to eject fluid from a well by sealing off the well. In wells, often the gas pressure in the well is insufficient to eject fluid from the well. By lowering a device into the fluid in a well, and sealing the well, the gas pressure builds up because the gas below the device can not diffuse upwardly through the fluid. The buildup of gas pressure is sufficient to propel a column of fluid in the well above the device and eject the fluid from the well.

Figure 1:
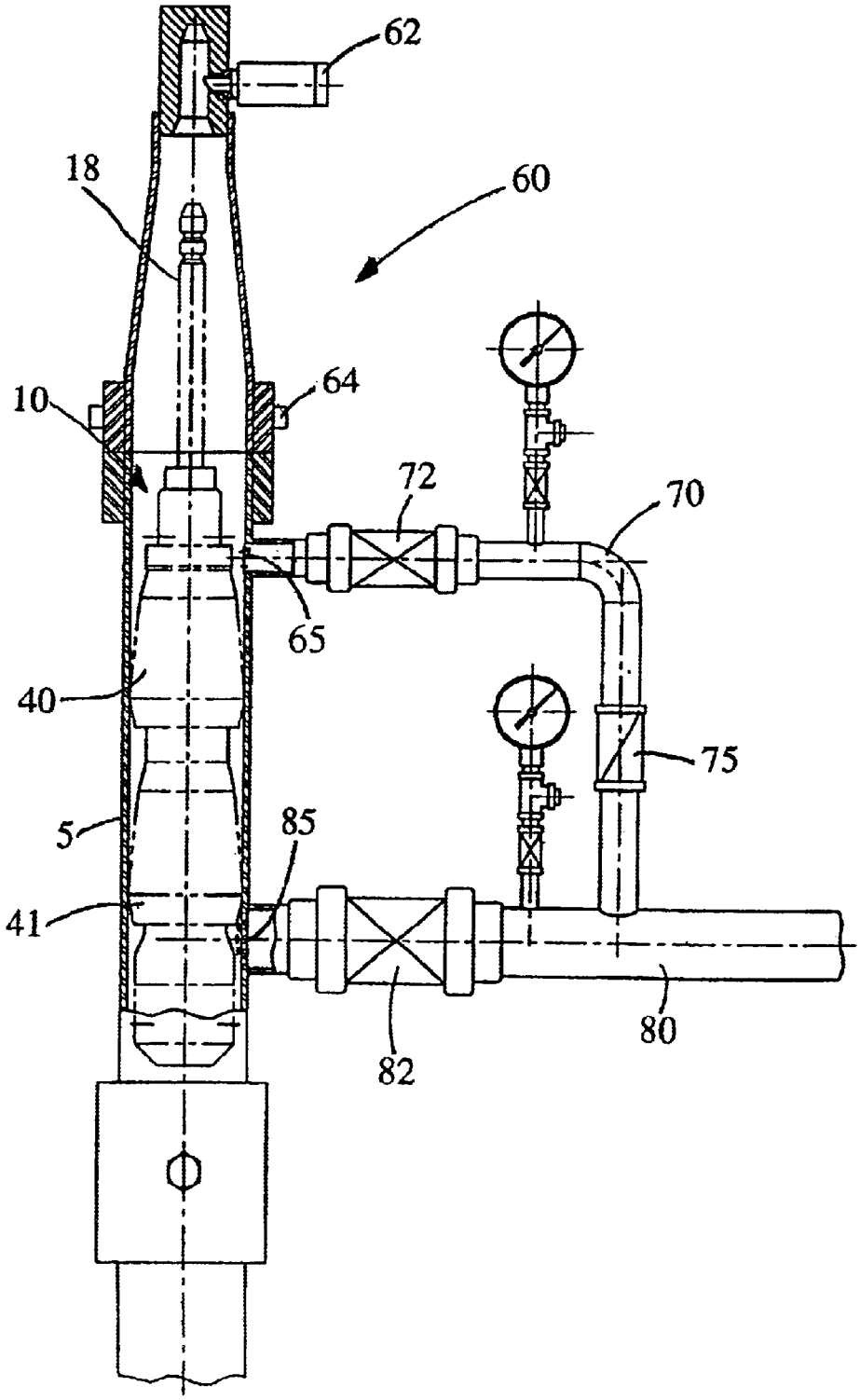
FIG. 1 is a view of a well-pumping system according to the present invention.
Figure 2:
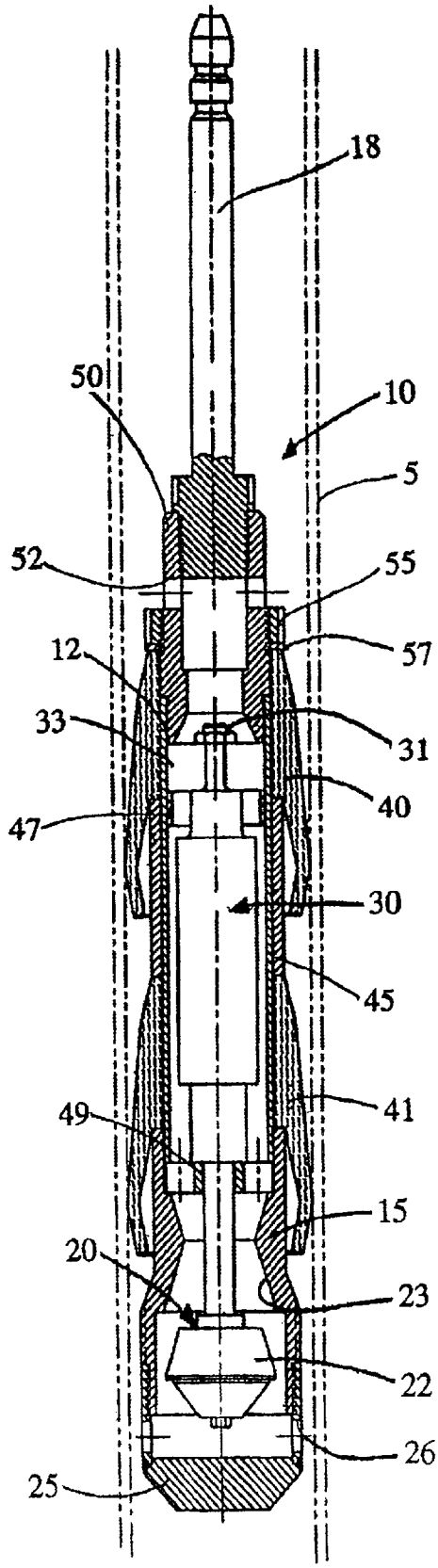
FIG. 2 is a cross sectional view of the pumping device of the well-pumping system illustrated in FIG. 1.

Referring now to FIGS. 1 and 2, a system for pumping liquid out of a well is illustrated. The system includes a pump 10 that forms a fluid-tight seal with the wall of a well 5. In FIG. 2 the pump 10 is illustrated down in the well. In FIG. 1, the pump 10 is illustrated at the top of the well.

To pump fluid out of the well, the pump 10 is lowered into the well 5, so that it sinks into fluid in the well. Once the fluid pressure in the well above the pump exceeds a threshold, the pump 10 seals-off the well. In doing so, the device seals in the gas in the well, causing the fluid pressure below the pump to build up. The fluid pressure below the pump then drives the pump upwardly along with the fluid above the pump. As the pump 10 is driven upwardly, the fluid above the pump is discharged through discharge lines 70, 80 connected to the well 5. When the pump reaches the top of the well, the gas pressure below the pump drives the pump into a receiver 60 that maintains the pump above the lower discharge 80 line while gas from the well flows through the line. When the flow of gas from the well diminishes, the pump 10 is lowered again to pump more fluid out of the well.

The raising and lowering of the pump 10 is controlled automatically in response to the fluid pressure in the well. Specifically, the pump 10 includes a valve 20 that controls the flow of fluid through the pump. A biasing element 30 controls the operation of the valve 20. More specifically, the biasing element 30 biases the valve 20 into an open position. When the valve 20 is open, the pump 10 descends into the well, and fluid flows through the pump. The rate of descent is limited by the friction between the pump and the well walls and flow restrictions through the pump. When the pump reaches the liquid level in the well, it continues to descend, but at a reduced rate.

When the pressure differential across the pump 10 exceeds a threshold (closing threshold) related to the biasing force of the biasing element, the valve 20 automatically closes so that fluid can no longer flow through the pump. As described above, the fluid pressure in the well builds up and then drives the pump upwardly. At the top of the well 5 the pump 10 is displaced into a receiver assembly 60 that maintains the pump. While the pump is maintained in the receiver, the gas pressure in the well dissipates as gas flows through the lower discharge line 80. When the fluid pressure across the pump drops below a threshold (opening threshold), the biasing element 30 automatically opens the valve 20 and the pump 10 descends again into the well. In this way, the pump automatically descends and ascends within the well to pump fluid from the well.

Referring now to FIG. 2, the details of the pump 10 will be described in greater detail. The pump 10 includes an elongated substantially hollow cylindrical housing 12. A lower housing 15 is fixedly attached to the lower end of the cylindrical housing 12. An end cap 25 closes the lower end of the lower housing. Preferably, the lower end cap 25 is releasably connected with the lower housing 15. In the present instance the lower end cap 25 is threadedly connected to the lower housing. A plurality of holes in the lower end cap 25 form inlet ports 26, so that fluid can flow into the pump 10 through the inlet ports 26 when the pump descends into the well.

A top cap 50 is attached to the upper end of the housing 12. The top 50 has a central bore providing a fluid path. The lower end of the top cap 50 is attached to the upper end of the housing 12. Preferably the top cap 50 is releasably connected to the housing; and in the present instance, the top cap 50 has external threads that mate with internal threads in the housing 12 to attach the top cap to the housing.

The upper end of the top cap 50 is generally open, and preferably includes an internally threaded portion for mounting a stem 18. The stem 18 is an elongated solid shaft that cooperates with the catcher latch 62 to hold the pump 10 at the top of the well, as discussed further below. The stem 18 preferably has an externally threaded portion cooperable with the top cap 50 to releasably attach the stem to the top cap. In this way, the stem threads into the top cap thereby sealing the upper end of the top cap.

As shown in FIG. 2, a plurality of holes through the sides of the top cap 50 provide outlet ports 52. In this way, fluid flowing through the pump 10 flows through the top cap 50 and out the outlet ports 52.

A plurality of sealing elements or cups 40, 41 disposed around the housing provide a fluid-tight seal between the housing and the inner wall of the well 5. The cups 40, 41 are disposed between the inlet ports 26 at the bottom of the pump 10 and the outlet ports 52 at the top of the pump. The cups 40, 41 are elastomeric elements having a central bore. The cups 40, 41 are spaced apart axially from one another by a spacer 45. The spacer 45 is an elongated cylindrical collar having an internal diameter slightly larger than the external diameter of the housing.

The cups 40, 41 and spacer 45 are captured on the housing between a locking ring 55 and a lip that is the formed by the top edge of the lower housing 15. Specifically, an internal annular shoulder of the lower cup 41 abuts both the top edge of the lower housing, and the locking ring 55 threaded onto the top cap 50 engages the top edge of the upper cup 40.

The locking ring 55 is a threaded collar or nut that cooperates with external threads on the top cap 50. In this way, the locking ring 55 is operable to tighten down or compress the cups 40, 41. Since the cups 40, 41 are formed of elastomeric material, preferably a metal washer is disposed between the locking ring 55 and the upper cup 40. The metal interface between the locking ring and the washer facilitates turning the ring to tighten down on the cups 40, 41.

During use, the cups may wear and need to be replaced. Accordingly, preferably the pump 10 is configured so that the cups 40, 41 can be readily removed and replaced without disassembling the pump. Therefore, in the present instance the top cap 50 is preferably configured so that it need not be removed to replace the cups. Specifically, preferably the exterior diameter of the top cap 50 is small enough to allow the cups to slide over the top cap. In particular, preferably the external diameter of the top cap 50 is approximately the same as, or less than, the external diameter of the housing.

Configured in this way, the cups 40, 41 can be replaced as follows. The locking ring 55 is unscrewed from the top cap 50 and removed along with the washer 57. The cups 40, 41 and spacer 45 are then slid off the housing and over the top cap. A new lower cup is then slid over the top cap and down over the housing until it engages the top edge of the lower housing 15. The spacer 45 is then slid over the top cap 50 and housing until it abuts the top edge of the new lower cup. A new upper cup is then slid over the top cap and down over the housing until it engages the top edge of the spacer. The washer 57 is then placed over the top cap 50 on top of the upper cup. Finally, the locking ring 55 is threaded onto the top cap and tightened down with the upper cup.

Referring to FIG. 2, the valve 20 controls the flow of fluid through the housing 12. In FIG. 2, the valve 20 and biasing element 30 are shown in elevation. The valve 20 comprises a valve element 22 that cooperates with a valve seat 23 to form a fluid-tight seal. Preferably, the valve element 22 is formed of an elastomeric material. The valve seat 23 is preferably a tapered annular surface formed in the interior wall of the lower housing.

When the valve is closed, fluid does not flow through the pump. In addition, since the cups 40, 41 provide a fluid-tight seal between the housing 12 and the wall of the well 5, fluid does not flow around the pump. Accordingly, when the valve 20 is closed, the pump 10 operates as a seal, sealing the well closed. This allows a pressure differential to build up across the tool. Specifically, when the valve is closed, the pressure below the cups increases relative to the pressure above the cups.

The biasing element 30 biases the valve 20 toward an open position in which fluid can flow through the pump through the inlet and outlet ports 26, 52. Preferably, the biasing element 30 is fixed relative to the housing 12, so that the biasing element is not displaceable relative to the housing. However, in some applications it may be desirable to allow the biasing element to be displaced relative to the housing. In the present instance, the biasing element 30 is fixed in place between the upper cap 50 and a retaining ring 47, as discussed further below.

The biasing element 30 can be formed of one of a number of elements for providing a biasing force against the valve 20. For instance, the biasing element could comprise a compression spring operable to bias the valve open. However, preferably, the biasing element 30 comprises a pressurized bellows, as discussed further below.

Figure 3:
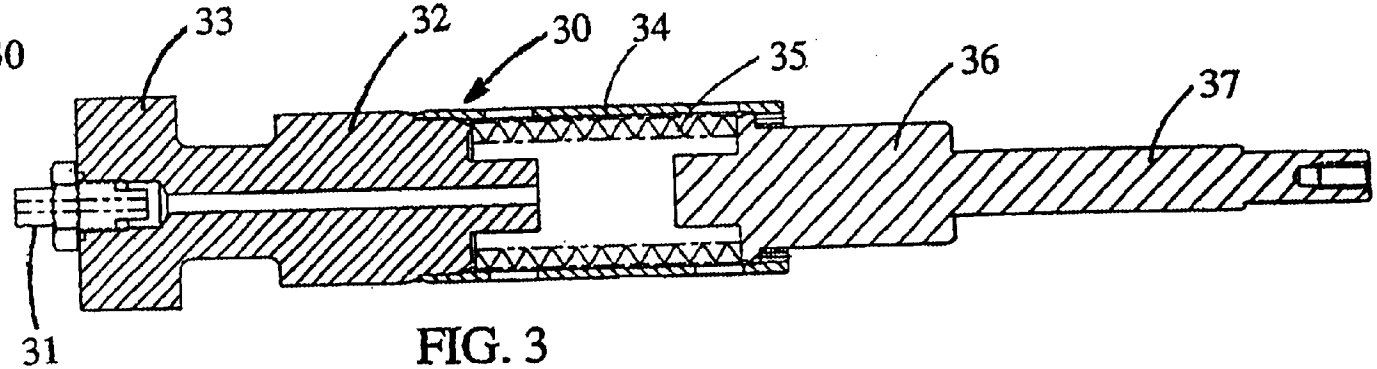
FIG. 3 is an enlarged cross-sectional view of a biasing element of the pumping device illustrated in FIG. 2.
Figure 5:
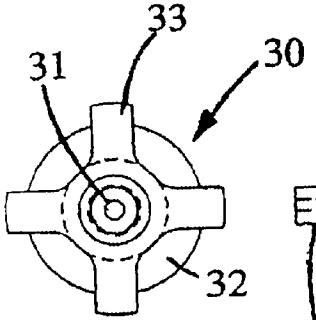
FIG. 5 is a side elevational view of the biasing element illustrated in FIG. 3.
Figure 4:
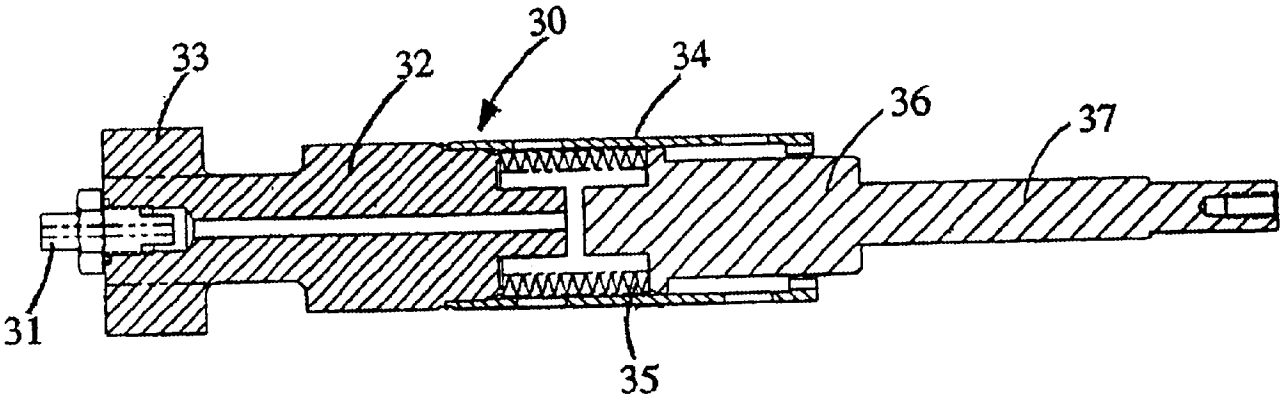
FIG. 4 is an enlarged cross-sectional view of a biasing element of the pumping device illustrated in FIG. 2, illustrating the biasing element in a retracted position.

Referring to FIGS. 3–5, the details of the biasing element 30 will be discussed in greater detail. The biasing element 30 comprises a housing 32, and a hollow canister 34 in which bellows 35 are disposed. The housing comprises an enlarged head formed by a plurality of radially extending tabs 33. Referring to FIG. 2, in which the biasing element is illustrated in elevation, the tabs 33 are captured between the top cap 50 and the retaining ring 47 to attach the biasing element to the housing 12. The retaining ring 47 is a cylindrical ring fixedly connected to the interior wall of the housing, such as by welding or pressfit. The retaining ring 47 forms a shoulder against which the tabs 33 of the biasing element 30 rests. The lower edge of the top cap 50 engages the tabs 33, so that when the top cap is threaded onto the housing 12, the tabs 33 are captured between the retaining ring 47 and the top cap. As shown in FIGS. 3 and 5, the tabs 33 are circumferentially spaced apart, so that fluid can flow between the tabs and the retaining ring.

The bellows 35 are operable to expand and contract vertically within the canister. The bellows canister 34 is substantially cylindrical and is fixedly attached to the lower end of the housing 32, circumscribing the bellows 35. A plurality of vent holes are formed in the side walls of the canister 34. The lower end of the canister is generally open, having an annular flange extending radially inwardly to form a lip. The opening is configured to cooperate with the exterior surface of a connecting block 36. The connecting block 36 is attached to the lower end of the bellows 35 so that the connecting block is displaced vertically when the bellows expand or contract.

The top end of the connecting block 36 flares outwardly forming a flange having a diameter substantially similar to the interior of the canister 34. In this way, the flange forms a sliding fit with the interior of the canister 34. The lip formed at the lower end of the cannister operates as a stop that cooperates with the flared head of the connecting block to prevent the connecting block 36 from being completely displaced out of the cannister.

An elongated rod 37 is connected with the lower end of the connecting block 36. Preferably, the rod 37 is integrally formed with the connecting block 36, as shown in FIGS. 3 and 4. The lower end of the rod 37 has a reduced diameter tip and an internally threaded bore. As shown in FIG. 2, the valve element 22 is mounted on the reduced diameter tip of the rod 37 by a bolt that is threaded into the tip of the rod. In this way, the valve element 22 is connected with the bellows, so that the valve element is displaced vertically when the bellows expand or contract.

In FIG. 3, the bellows 35 is illustrated in an extended position, which corresponds to the valve being opened as illustrated in FIG. 2. In FIG. 4, the bellows is illustrated in a contracted position, which corresponds to the valve being closed so that the valve element 22 seals against the valve seat 23.

Referring to FIG. 2, preferably, an alignment ring 49 for supporting and aligning the rod 37 is disposed in the lower housing 15. The alignment ring has a central bore corresponding to the external diameter of the rod 37, forming a sliding fit between the rod and the central bore of the ring. The alignment ring 49 also includes a plurality of holes so that fluid can flow through the alignment ring when the valve 20 is open.

The bias of the biasing element 30 is controlled in part by the fluid pressure within the bellows 35. As shown in FIGS. 3–5, a cavity is formed within the bellows 35. An air-fill valve 31 attached to the housing 32 of the biasing element controls the flow of fluid into the bellows 35. In this way, the bellows can be charged by filling the bellows with pressurized air through the air-fill valve 33. As the bellows are filled with pressurized air, the bellows expand outwardly, displacing the connecting block 36 and attached valve element 22 downwardly. The airfill valve 31 can be accessed without disassembling the pump 10, by simply unscrewing the stem 18 from the top cap 50.

The bellows 35 compresses in response to hydrostatic pressure on the bellows when the pump is in the liquid in the well. As the bellows compresses, the valve 20 closes. The stroke of the valve element 22 between the opened position and the closed position corresponds to the compression of the bellows from the charged length to the compressed length when the valve 20 is closed. The biasing element 30 is configured to reduce the volume of the bellows cavity, thereby increasing the bellows compression ratio, as described further below.

Figure 6:
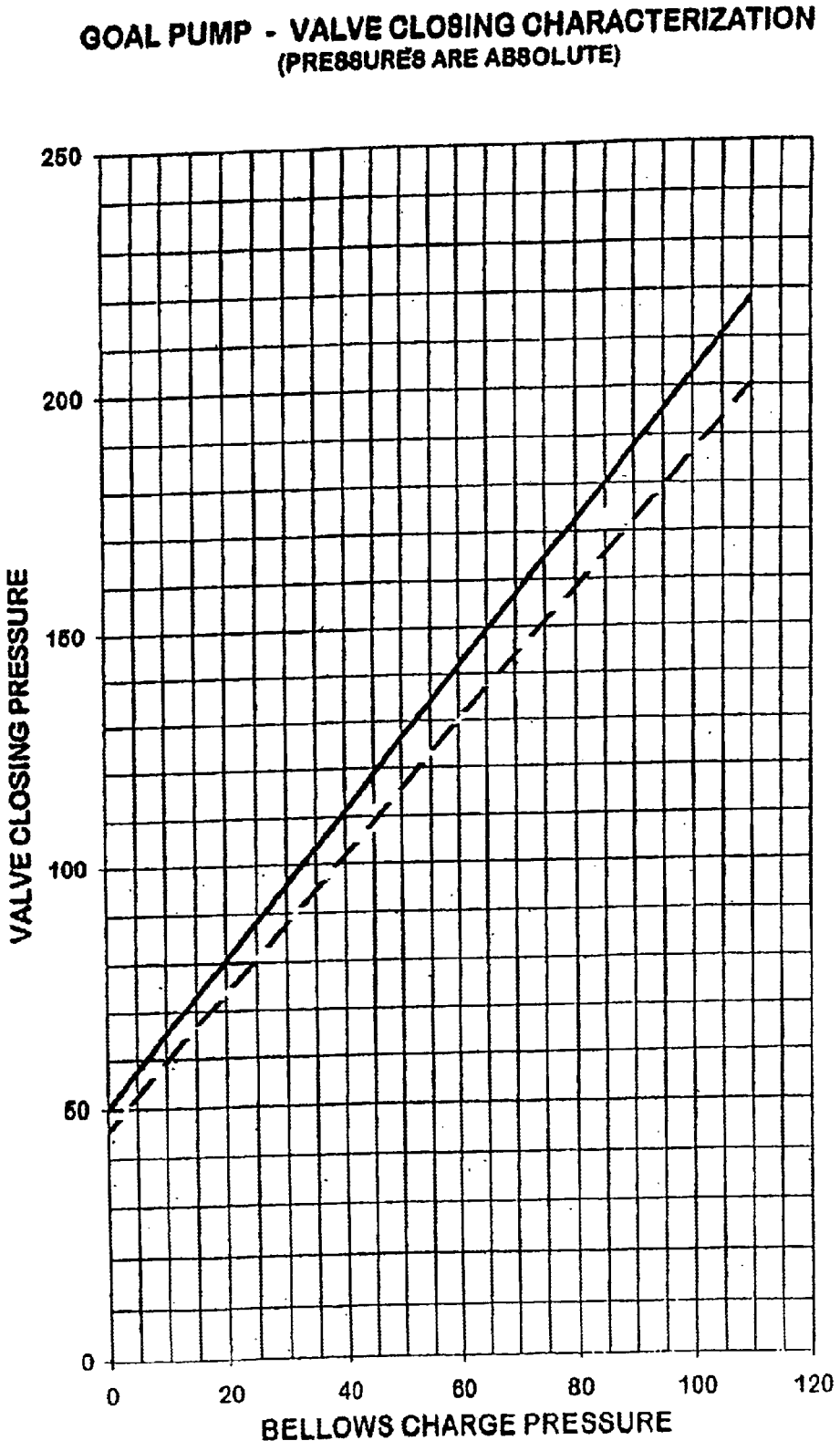
FIG. 6 is a graphic presentation relating the down well valve closing pressure to the bellows initial charge pressure and the relevant physical parameters of the bellows and valve assembly.

The force of the biasing element 30 opposing the fluid pressure on the bellows is also influenced by the weight of the valve element 22 and connecting rod 37, as well as the effective cross-sectional area of the bellows. Referring to FIG. 6, the relationship between the valve closing pressure and the bellows charge pressure is illustrated. The slope of this line is equal to the compression ratio of the bellows (the charged volume/the compressed volume) corrected for the bellows temperature change (operating temperature (absolute)/charge temperature (absolute)). The Y axis intercept of this line is the sum of the bellows bias force and the weight of the valve element 22 and connecting rod 37 divided by the effective cross-sectional area of the bellows. It is to be noted that, to a first order, valve geometry does not affect the valve closing pressure.

The dashed line on FIG. 6 represents the same design, with the exception that the valve 20 is positioned initially 10% closer to the valve seat 23 (a 10% reduction in bellows stroke). If the charged volume for the bellows cavity is fixed, reducing the bellows stroke 10% increases the volume of the compressed volume for the bellows, thereby decreasing the bellows compression ratio. As can be seen by FIG. 6 decreasing the bellows compression ratio decreases the sensitivity of the valve closing pressure to the bellows pressure. In other words, for an increased bellows compression ratio, a change in bellows pressure causes a greater change in the valve closing pressure relative to a lower bellows compression ratio. Accordingly, preferably the bellows compression ratio is greater than approximately 1, and more preferably is between 1.1 and 2.2.

Referring to FIG. 1, the pumping device 10 is illustrated at the well head. An upper discharge line 70 and lower discharge line 80 are connected to the well 5 for receiving the fluid from the well. The upper discharge line 70 extends between the well 5 and the lower discharge line 80. Preferably, the lower discharge line 80 is approximately twice as large in diameter as the upper discharge line 70. The opening from the well 5 to the upper discharge line 70 is vertically spaced along the well from the opening to the lower discharge line 80 a distance that is greater than the distance from the point that the lower cup 41 seals with the well to the point that the upper cup 40 seals with the well. In this way, when the device 10 is at the top of the well the lower cup 41 seals against the well at a point above the opening to the lower discharge line 80, and the upper cup 40 seals against the well at a point below the opening to the upper discharge line 70, as shown in FIG. 1.

The cups 40, 41 may catch on the openings to the upper and lower discharge lines 70, 80 when the cups pass over either of the openings. Over time, this may accelerate the wear on the cups leading to reduced life of the cups. Therefore, preferably, covers 65, 85 cover the openings to the discharge lines 70, 80. The covers 65, 85 are perforated to allow fluid to readily flow from the well into the discharge lines. The covers create a smoother surface along the wall of the well 5, reducing the wear between the cups 40, 41 and the well at the discharge lines.

A check valve 75 is disposed along the upper return line. The check valve 75 is configured to allow higher pressure fluid in the upper discharge line 70 to flow into the lower discharge line 80 and to impede fluid flow from the lower discharge line up into the upper discharge line. In this way, preferably the fluid in the upper discharge line remains at a higher pressure than the fluid in the lower discharge line to prevent fluid from flowing from the lower discharge line into the upper discharge line and into the well above the device 10. In addition, an upper shut-off valve 72 is provided on the upper discharge line 70 to shut-off the upper discharge line, and a lower discharge valve 82 is provided to shut-off the lower discharge line. The shut-off valves 72, 82 may be any one of a number of types of valves, such as a ball valve.

The receiver assembly 60 is disposed at the top of the well head is configured to receive the pump 10 and retain the pump at the top of the well. Specifically, the receiver assembly 60 includes a catcher latch 62 for engaging the stem 18 of the device. The stem 18 includes at least one circumferential groove that cooperates with the latch 62 to hold the device in the receiver 60. The latch 62 is spring loaded radially inwardly, so that as the pump is displaced upwardly into the receiver, the latch rides over the surface of the stem until it engages the circumferential groove on the stem. In this way, the latch 62 mechanically couples with the stem to hold the pump in the receiver so that the pump will not descend into the well even after the valve reopens. The top of the receiver assembly 60 is preferably attached to the well head by a coupling, such as a hammer union 64. Therefore, the device 10 can be removed from the well for service by catching the device in the receiver 60 with the latch 62 and then uncoupling the hammer union to remove the top of the receiver.

To lift the pump so that the latch 62 catches the pump, the lower discharge line is shut-off by the shut-off valve 82. As shown in FIG. 1, during normal use, the fluid pressure in the well below the pump suspends the pump so that the lower cup 41 is just above the lower discharge line. By shutting the lower shut-off valve 82, the fluid pressure in the well pushes the pump further up until the lower cup 41 is just above the upper discharge line 70. In this position, the stem is in the receiver far enough for the latch 62 to engage the groove in the stem 18.

FIG. 1 illustrates the pumping device at the well head just below the receiver. As the pump is rising, but before it reaches the lower discharge line 80, the liquid carried to the surface above the pump is discharged through the lower discharge line. As the amount of liquid above the pump decreases, the positive pressure differential across the pump increases, thereby accelerating the pump into the receiver assembly 60. The gas and liquid remaining above the friction cups 40, 41, cushion the pump as the pump enters the receiver. The gas and liquid remaining above the pump in the receiver exhaust through the upper discharge line 70, which is isolated from the lower discharge line by a check valve 75. The check valve 75 prevents fluid flow from the lower discharge line 80 back into the receiver 60 above the pump.

When the friction cups 40, 41 pass above the lower discharge line 80, the shut-in well gas pressure discharges into the lower discharge line. The flow control valve 20 in the pump remains in the closed position as the shut-in pressure dissipates. The check valve 75 provides separation between the pressure above the pump (i.e. above the friction cups 40, 41) and the dissipating shut-in pressure in the lower discharge line 80, thereby maintaining a positive pressure differential across the pump 10. The gas pressure in the well is sufficient to support the pump to maintain it in the receiver until the valve 20 opens. As the fluid pressure in the well decreases below the preset pressure differential across the pump (from the high shut-in pressure), the flow control valve 20 opens. When the valve is opened, the pressure differential across the pump approaches zero and the pump descends into the well for additional liquid pumping.

The pressure differential between the valve opening pressure and the valve closing pressure corresponds to the amount of liquid that the pump 10 can pump out of the well. The greater the pressure differential, the greater the amount of liquid can be pumped out in a single pump stroke. Therefore, it is desirable to maximize the pressure differential between the valve opening pressure and the valve closing pressure.

Figure 7:
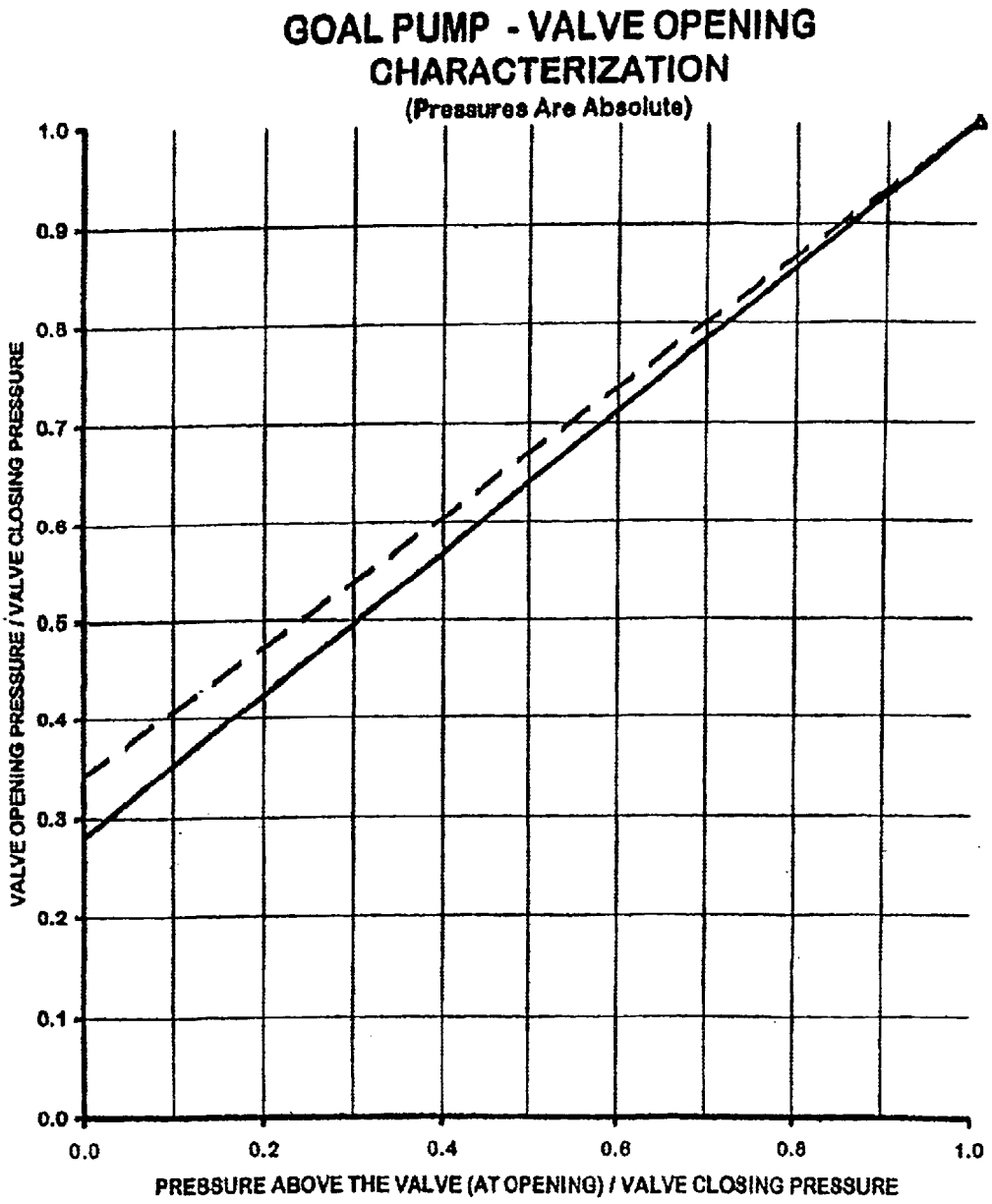
FIG. 7 is a graphic presentation relating the valve opening pressure to the valve closing pressure and to the pressure above the valve at the time of opening.

FIG. 7 illustrates the relationship between control valve 20 opening pressure and control valve closing pressure as a function of the pressure above the control valve (i.e., above the friction cups 40, 41) at the time of control valve opening. The value at which the curve intercepts the left axis (Popen/Pclose) is a function (to a first order) of the ratio of the bellows effective cross sectional area to the cross sectional area of the valve seat 23. It is independent of bellows charge pressure, spring forces, bellows stroke, etc. For this reason a large valve seating area and a small bellows cross sectional area will provide improved (lower) control valve opening pressures. The dashed line illustrates a 10% reduction in valve (5) cross-sectional seating diameter. Accordingly, preferably the cross-sectional area of the bellows 35 is less than the cross-sectional area of the valve seat 23. More specifically, preferably the ratio of the cross-sectional area of the bellows divided by the cross-sectional area of the valve seat is within the range of 0.15 to 0.5.

The amount of liquid that will be lifted to the surface on subsequent pumping runs is determined from the selected control valve closing pressure (for a given design implementation, this is controlled by the bellows charging pressure and the bellows stroke) reduced by the valve opening pressure (controlled by the valve cross sectional seating area, which can be adjusted by stroke or shim washers) but increased by the decrease in casing pressure during the downward transit of the pump. The resulting pressure is related to the height of the column of liquid to be pumped by the density of the liquid (typically for salt water about 100 feet of liquid in a 4 inch casing per each 44 PSIG).

It will be recognized by those skilled in the art that changes or modifications can be made to the above-described embodiments without department from the broad inventive concept of the invention. It should therefore be understood that this invention is not limited to the particular embodiments described herein but is intended to include all changes and modifications that are within the scope and spirit of the invention as set forth in the following claims.

What is claimed is:

1. A device for pumping a well having sidewalls comprising:

a case having an upper end and a lower end;

a seal disposed intermediate the upper end and lower end, forming a fluid-tight seal between the case and the well sidewall;

a fluid passage extending through the case, having an inlet port below the seal and a discharge port above the seal; and a pressure sensitive valve system disposed within said fluid passage comprising a valve and a pressure sensitive element positioned above the valve, such that the valve system automatically closes when a pressure on the pressure sensitive element is greater than a closing pressure, and opens automatically in response to reduced pressures on the valve and pressure sensitive element wherein the valve cooperates with a valve seat, and the pressure sensitive element has a cross-sectional area that is less than the cross-sectional area of the valve seat.

2. The device of claim 1 wherein the valve system seals the fluid passage when the valve system is closed, thereby substantially impeding fluid flow through device when the valve system is closed.

3. The device of claim 1, wherein the pressure sensitive valve system is fixedly attached to the case.

4. The device of claim 1, wherein the pressure sensitive element is a bellows.

5. The device of claim 4, wherein the bellows is pressurized to provide a bias pressure to hold the valve open, wherein the closing pressure is related to the bias pressure.

6. The device of claim 4 wherein the ratio of the cross-sectional area of the bellows to the cross-sectional area of the valve seat is less than approximately 0.5.

7. The device of claim 4 wherein the ratio of the cross-sectional area of the bellows to the cross-sectional area of the valve seat is between approximately 0.15 and approximately 0.5.

8. The device of claim 1 wherein the seal is removably attached to the case.

9. The device of claim 1 wherein the valve is configured so that when the valve is closed, the fluid pressure in the well below the device urges the valve closed.

10. The device of claim 1 wherein the bellows is positioned within the case between the inlet port and the discharge port.

11. The device of claim 1 wherein the well comprises:

a well having a well head with an upper exit port and a lower exit port;

a fluid line connecting the upper exit port and the lower exit port;

wherein the device is receivable within the well head between the upper exit port and the lower exit port when the valve system is closed, and the device remains in the well head until pressures on the valve and pressure sensitive element are sufficiently reduced so that the valve system opens automatically, wherein the device automatically falls into the well.

12. A system for pumping a well comprising a well having a well head with an upper exit port and a lower exit port;

a fluid line connecting the upper exit port and the lower exit port;

a pump operable to pump liquid out of the well, wherein the pump is receivable within the well head; and a check valve along the fluid line for controlling pressure in the well head above the pump when the pump is in the well head.

13. The system of claim 12, wherein the pump is suspended within the well head intermediate to the upper exit port and lower exit port.

14. The system of claim 13, wherein the lower exit port receives fluid flow from the well head while the pump is suspended within the well head.

15. The system of claim 12 wherein the pump comprises two axially spaced apart seals forming a fluid-tight seal with the well, and the upper exit port is spaced apart from the lower exit port a distance greater than the distance between the two seals on the pump.

16. A method of automatically swabbing a well with a device having a pressure sensitive valve system controlling the flow of fluid through a fluid passage in the pump wherein the well comprises a receiver and a discharge line having a shut-off valve, comprising the steps of:

(a) lowering the device into the well, so that liquid in the well flows through a fluid passage in the pump as the pump sinks into the liquid;

(b) automatically closing the valve system to seal the well closed while the pump is in the well;

(c) ejecting the pump from the well;

(d) collecting fluid from the well after the pump is ejected, and while the valve system is closed;

(e) automatically opening the valve system when the fluid pressure in the well dissipates below an opening pressure; and (f) closing the shut-off valve so that the fluid pressure in the well drives the pump into the receiver.

17. The method of claim 16 wherein the pressure sensitive valve system comprises a bellows and the method comprises the step of pressurizing the bellows with pressurized air.

18. A device for pumping a well having sidewalls comprising:

a case having an upper end and a lower end;

a seal disposed intermediate the upper end and lower end, forming a fluid-tight seal between the case and the well sidewall;

a fluid passage extending through the case, having an inlet port below the seal and a discharge port above the seal; and a pressure sensitive valve system disposed within said fluid passage comprising a valve and a pressure sensitive element positioned above the valve, such that the valve system automatically closes when a pressure on the pressure sensitive element is greater than a closing pressure, and opens automatically in response to reduced pressures on the valve and pressure sensitive element, wherein the pressure sensitive valve system is fixedly attached to the case.

19. The device of claim 18 wherein the valve system seals the fluid passage when the valve system is closed, thereby substantially impeding fluid flow through device when the valve system is closed.

20. The device of claim 18 wherein the valve cooperates with a valve seat and the ratio of the cross-sectional area of the bellows to the cross-sectional area the valve seat is less than approximately 0.5.

21. The device of claim 18 wherein the ratio of the cross-sectional area of the bellows to the cross-sectional area of the valve seat is between approximately 0.15 and approximately 0.5.

22. The device of claim 18 wherein the pressure sensitive element is a bellows.

23. The device of claim 18 wherein the bellows is pressurized to provide a bias pressure to hold the valve open, wherein the closing pressure is related to the bias pressure.

24. The device of claim 18 wherein the well comprises:

a well having a well head with an upper exit port and a lower exit port;

a fluid line connecting the upper exit port and the lower exit port;

wherein the device is receivable within the well head between the upper exit port and the lower exit port when the valve system is closed, and the device remains in the well head until pressures on the valve and pressure sensitive element are sufficiently reduced so that the valve system opens automatically, wherein the device automatically falls into the well.

* * * * *

UNITED STATES PATENT AND TRADEMARK OFFICE

CERTIFICATE OF CORRECTION

PATENT NO. : 6,851,480 B2
DATED : February 14, 2005
INVENTOR(S) : Gerald Swoyer et al.

It is certified that error appears in the above-identified patent and that said Letters Patent is hereby corrected as shown below:

Column 9,
Line 42, "when a pressure on" should read -- when pressure on --;

Column 11,
Line 22, "cross-sectional area the valve seat" should read -- cross-sectional area of the valve seat --;

Signed and Sealed this

Third Day of May, 2005

JON W. DUDAS
*Director of the United States Patent and Trademark Office*